US006176105B1

(12) United States Patent
Hung Chan et al.

(10) Patent No.: US 6,176,105 B1
(45) Date of Patent: Jan. 23, 2001

(54) WIDENING METHOD FOR A RIB KNITTED FABRIC AND A WIDENED RIB KNITTED FABRIC THEREBY

(75) Inventors: Roger Kwok Hung Chan, Gladstone Park (AU); Takahumi Kamei, Wakayama (JP)

(73) Assignee: Shima Seiki Manufacturing, Ltd., Wakayama (JP)

( * ) Notice: Under 35 U.S.C. 154(b), the term of this patent shall be extended for 0 days.

(21) Appl. No.: 09/203,406

(22) Filed: Dec. 2, 1998

(30) Foreign Application Priority Data

Dec. 3, 1997 (JP) ..... 9-332537

(51) Int. Cl.[7] ..... D04B 7/10

(52) U.S. Cl. ..... 66/70; 66/71; 66/76; 66/198; 66/200

(58) Field of Search ..... 66/64, 67, 69, 66/70, 71, 73, 76, 77, 169 R, 170, 171, 198, 199, 200

(56) References Cited

U.S. PATENT DOCUMENTS 2,141,440 * 12/1938 Lawson et al. ..... 66/70
2,616,275 * 11/1952 Bennington .
3,668,896 * 6/1972 Betts et al. ..... 65/70
3,668,898 * 6/1972 Betts et al. ..... 66/70
5,305,619 * 4/1994 Shima et al. ..... 66/70
5,505,062 * 4/1996 Okuno ..... 66/70
5,701,766 * 12/1997 Takahasi ..... 66/70

* cited by examiner

*Primary Examiner*—John J. Calvert
*Assistant Examiner*—Larry D. Werrell, Jr.
(74) *Attorney, Agent, or Firm*—Nikaido, Marmelstein, Murray & Oram LLP

(57) ABSTRACT

For preventing holes from occurrence at an internally widened area of a rib knitted fabric, at the area, two needles, one on the front needle bed, the other on the back needle bed, are made empty. Then, a stitch held by an adjacent needle to one of the two empty needles is transferred to the other of the two empty needles so that two continuous needles on one needle bed are made empty and that the former empty needle on the other needle bed is provided with the transferred stitch. A yarn feeder is made to move over the area while feeding yarn till one needle before the two empty needles, then back above the area while feeding the two empty needles and an intermediate opposing bed needle, and move over the area while feeding yarn from the subsequent needles after the two former empty needles.

5 Claims, 6 Drawing Sheets a b c d e f g h i j k l m n o p q
A B C D E F G H I J K L M N O P Q
20
21
22
23
31
32
33
35
37
39
41
43 a b c d e f g h i j k l m n o p q
A B C D E F G H I J K L M N O P Q
120
121
122
123
131
132
133
135
137
141
143

WIDENING METHOD FOR A RIB KNITTED FABRIC AND A WIDENED RIB KNITTED FABRIC THEREBY

SPECIFICATION

A Widening Method for a Rib Knitted Fabric and a Widened Rib Knitted Fabric Thereby 1. Field of the Invention The present invention relates to a widening method for a rib knitted fabric knitted with needles of a front needle bed and a back needle bed of a flat knitting machine and a widened rib knitted fabric thereby.

2. Prior Art

In knitting a knitted fabric with a flat knitting machine, fashioning or the like has been practiced by increasing the number of wales of the knitted fabric, and widening for forming a new stitch has been used for this purpose.

Widening can be done by a method wherein a new stitch is formed on an empty needle located outside a side edge of a knitted fabric to gradually expand the knitting range (hereinafter referred to as external widening), and by a method wherein a group of stitches of a desired number of wales including the most outside wale of a side edge of a knitted fabric is moved outward, and a stitch is formed on an empty needle generated by that outward movement in the knitting range to expand the knitting range (hereinafter referred to as internal widening).

In external widening, as a new wale or wales are formed on a side part of a knitted fabric by widening, the side part of the knitted fabric will become irregular. In contrast to this, in internal widening, as a new wale or wales are formed inside a knitted fabric, well-balanced wales will appear in both side parts of the knitted fabric; thus the finished knitted fabric will have neat and regular side ends. Hence internal widening is superior to external widening in terms of neat finish of post processing such as sewing of side ends of a knitted fabric or fabrics after completion of knitting, and work efficiency, and internal widening is normally used.

The conventional internal widening will be described by way of an example of a rib knitted fabric illustrated in FIG. 7. The courses of step 1 and step 2 are repeated an appropriate number of times to complete knitting just short of a widening area. Next, stitches are moved sequentially by transferring stitches and racking a needle bed, as shown in step 3, to make empty, a needle F of the front needle bed and a needle f of the back needle bed on which new stitches will be formed. An empty needle means a needle holding no yarn.

Next, in step 4, yarn is fed alternately and sequentially to needles A~P of the front needle bed and needles a~p of the back needle bed in a travelling direction of the yarn feeder. As a result, knit stitches are formed on needles except the needles F, f that have been made empty. As the needles F, f do not hold stitches of the previous course, no stitches are formed but the yarn is hooked on these needles F, f.

Next, to form a new wale on the needle L of the front needle bed and the needle l of the back needle bed, stitches held on needles L~P of the front needle bed and stitches being held on needles l~p of the back needle bed are moved sequentially by transfer and racking. As a result, the needle L of the front needle bed and the needle l of the back needle bed are made empty, holding no stitch, as shown in step 5. In step 6, the yarn is alternately fed to needles A~Q of the front needle bed and needles a~q of the back needle bed being the full width of the knitting range. In this widening, to make internal widening, the yarn is fed sequentially, in the travelling direction of the yarn feeder, to the needles F, f, L, l that have been made empty, to hook the yarn on these empty needles. However, as the needles F, f, L, l do not hold any stitch of the preceding course, when the yarn being hooked on these needles are formed into stitches by knitting of the succeeding course, the stitches on the needles F, f, L, l will be pulled up, leaving a conspicuous holes in the widened area.

To solve this problem, the present applicant has proposed a new widening method in Japanese Provisional Patent Hei 7-54245, corresponding to U. S. Pat. No. 5,505,062. According to this method, stitches are shifted either leftward or rightward to make empty a pair of needles, one on the front needle bed and the other on the back needle bed, in a widening area. Next, stitches of the next course are formed from one end of the knitting range to just short of the empty needles of the widening area, and the travelling direction of the yarn feeder is turned at the widening area, and after that, the travelling direction of the yarn feeder is turned again. During this time, the yarn is hooked on the pair of empty needles, and in succession, the yarn is fed again to the ex-empty-needles, on which the yarn is hooked, to form stitches. After that, stitches of the succeeding course are formed on needles beyond the widening area. In this way, stretches of the yarn crossing between stitches formed in the widened area and stitches of adjacent wales can be made shorter. Moreover, course differences between the widened area and the other areas are reduced, and in turn, the stitches formed in the widened area are prevented from being pulled up by stitches of other areas. As a result, holes are made less conspicuous. However, now it is required to make such holes completely inconspicuous.

SUMMARY OF THE INVENTION

The objective of the present invention is to provide a widening method for a rib knitted fabric that generates no holes in a widened area and a rib knitted fabric produced thereby.

The widening method for a rib knitted fabric according to the present invention is a widening method for a rib knitted fabric using a flat knitting machine having at least a pair of a front needle bed and a back needle bed being relatively movable leftward and rightward, said method characterized by the following steps after making empty a pair of needles comprising a needle of the front needle bed and a needle of the back needle bed:

a. a step for making empty adjacent two needles on one same needle bed by transferring a stitch being held on a needle adjacent to one of said pair of empty needles to the other needle of said pair of empty needles;

b. a step for rib knitting by, while a yarn feeder is made to travel beyond said adjacent two empty needles, feeding yarn in the travelling direction of the yarn feeder to needles of both the front and back needle beds, up to the needle just short of said adjacent two empty needles;

c. a step for, while said yarn feeder is reversed and moved, hooking yarn on one of said adjacent two empty needles, forming a stitch on a needle of the other needle bed located between said two adjacent empty needles, and hooking yarn on the other needle of said two adjacent empty needles; and d. a step for feeding yarn to needles of both the front and back needle beds to rib-knit, said needles being in succession to said two adjacent needles, while said yarn feeder is reversed again and moved.

The needle of the other needle bed located between said two adjacent empty needles mentioned in the step c, is, for example, the original empty needle to which a stitch was transferred in the step a. As shown in FIG. 6, in addition to expanding the knitting range of a rib knitted fabric, the present invention may be applied to other uses. However, preferably, at least on one of left and right side parts of the rib knitted fabric, for example, the steps a~d are repeated to expand the knitting range of the rib knitted fabric. In this case, rib knitting for the full knitting range, etc. may be added between steps a~d and next steps a~d.

In rib knitting, it has been known to knit by making active every other needle of both the front and back needle beds, and in this case, the ratio of needles in use to needles not in use is one to one. In such a case, two adjacent needles in the present invention are interpreted to have an inactive needle between them.

The present invention also provides a widened rib knitted fabric having a large number of stitches, rows of said stitches along the knitting direction forming courses and columns of said stitches perpendicular to the courses forming wales, wherein a pair of widening wales are provided on both sides of a central wale, at a first course of said pair of widening wales, a stitch of a wale adjacent to three wales comprising said central wale and said pair of widening wales and outside one side of the group of said three wales, and a first stitch of one of the widening wales are connected by cross-over yarn crossing said three wales and striding over the central wale, a stitch of the central wale in said first course is connected to said first stitch of one of the widening wales, and a first stitch of the other widening wale is connected to said stitch of the central wale, and a stitch of a wale in said first course adjacent to said three wales and outside the other side of the group of said three wales is connected to the first stitch of the other widening wale.

Preferably, said widened rib knitted fabric has a course immediately preceding the first course of said pair of widening wales, and said stitch of the wale adjacent to three wales and outside is connected to a stitch of the same wale in said immediately preceding course, and said stitch of the one side wale adjacent to said three wales and outside the other side is connected to a stitch of the same wale in said immediately preceding course.

In a rib knitted fabric that is widened by the widening method according to the present invention, a pair of widening wales are present on both sides of a central wale in a widened area. The first stitch of one of the pair of widening wales is connected to cross-over yarn that extends from the outside of these three wales and strides over the central wale, and a stitch of the central wale is connected to this first stitch. The other end of the stitch of the central wale is connected to the first stitch of the other widening wale, and the other end of this first stitch of the other widening wale is connected by cross-over yarn striding over the central wale to a stitch outside of these three wales. One end of each of the first stitches of the pair of widening wales is supported by a central wale stitch in a course earlier. The other end of each of the first stitches of the pair of widening wales is connected to cross-over yarn striding over these three wales and supported by a stitch of outside wales in a course earlier. When a force is exerted to pull the first stitches of the widening wales, these stitches will be supported by the stitch of the central stitch and the stitches of said outside wales. The cross-over yarn striding over the central wale covers holes and makes them inconspicuous even if these stitches are pulled up.

EMBODIMENT

Figure 1:
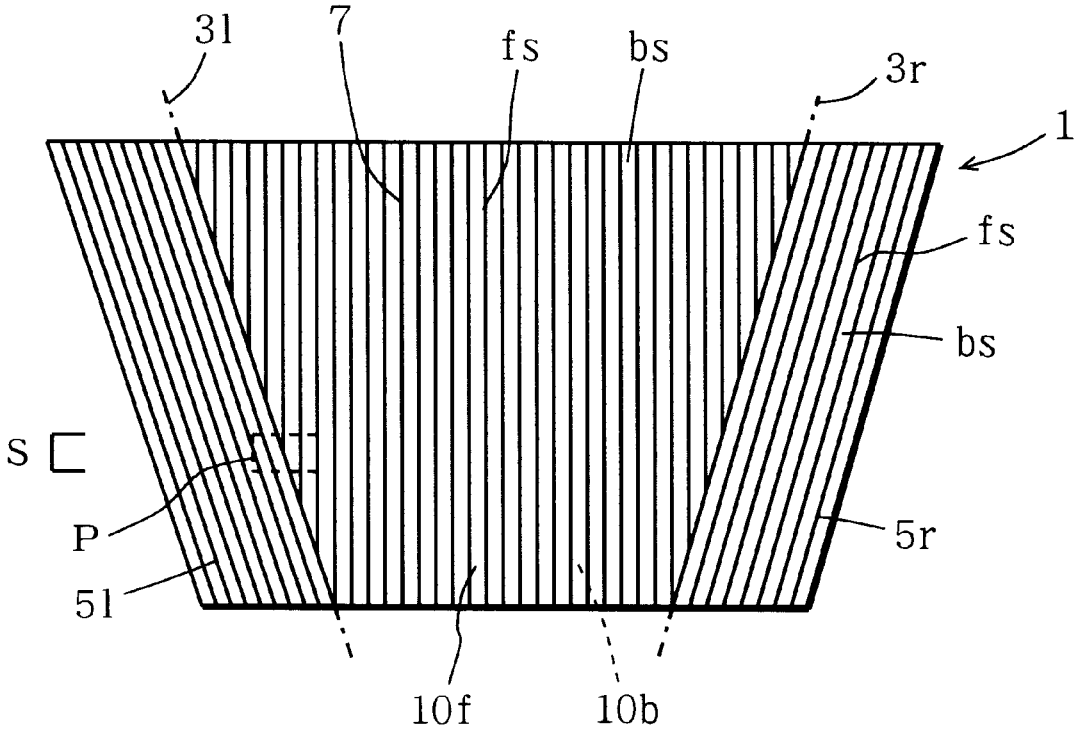
FIG. 1 illustrates a rib knitted fabric according to the present invention.

With reference to attached drawings, an embodiment of the widening method for a rib knitted fabric according to the present invention will be described in detail in relation to internal widening. In this embodiment, a flat knitting machine having at least a pair of a front needle bed and a back needle bed, either one or both of said needle beds able to be racked sidewise, is used, and with the front and back needle beds being shifted by a half needle pitch from each other, yarn is fed to both the front and back needle beds to knit a stitch course of a rib knitted fabric. FIG. 1 generally shows a rib knitted fabric 1 comprising entirely a rib knitted fabric that is internally widened by the method according to the present invention. In the diagram, the fabric 1 is seen from its face side 10*f*. Here the face side of the knitted fabric is determined as a side from which one can see the face stitches of the stitches formed on the needles of the front needle bed and the back stitches of the stitches formed on the needles of the back needle bed. Every time a group of stitches of a side part 5*r* or 5*l* located outside a widening line (widened part) 3*r* or 3*l* is shifted outward away from the central part 7, widening is effected along the widening line 3*r* or 3*l* (r and l represent right and left, respectively; l in 3*l*, 5*l*, etc. is a small letter of L). In the rib knitted fabric 1, as the face stitch fs and the back stitch bs are arranged alternately in the direction of the course, ribs are formed on the surfaces of the knitted fabric.

EMBODIMENT 1

Figures 1, 2, 3, 4, 5, 6, 7, 8, 9, 10:
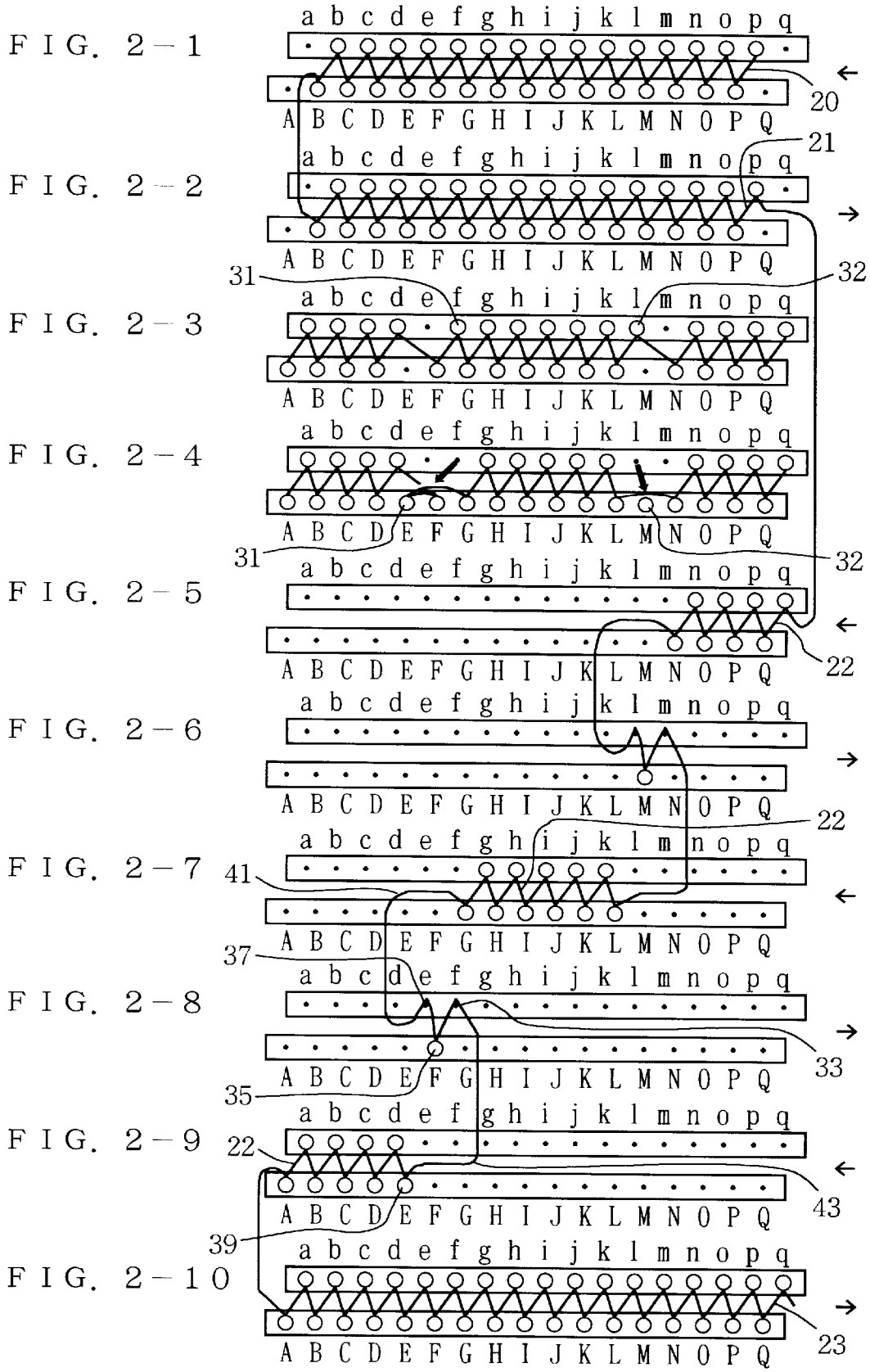
FIG. 2 shows knitting steps 1 to 10 according to an embodiment of the invention for knitting an internally widened portion S in the rib knitted fabric shown in FIG. 1.
FIG. 3 shows enlargedly the loop structure of the knitted fabric according to the embodiment in the widened area P in FIG. 1.
FIG. 4 shows knitting steps, corresponding to those in FIG. 1, according to a version of the invention.
FIG. 5 shows the loop structure according to the version.
FIG. 6 illustrates a version of rib knitted fabric according to the invention.
FIG. 7 shows knitting steps for rib knitted fabric according to Prior Art.
Figure 3:
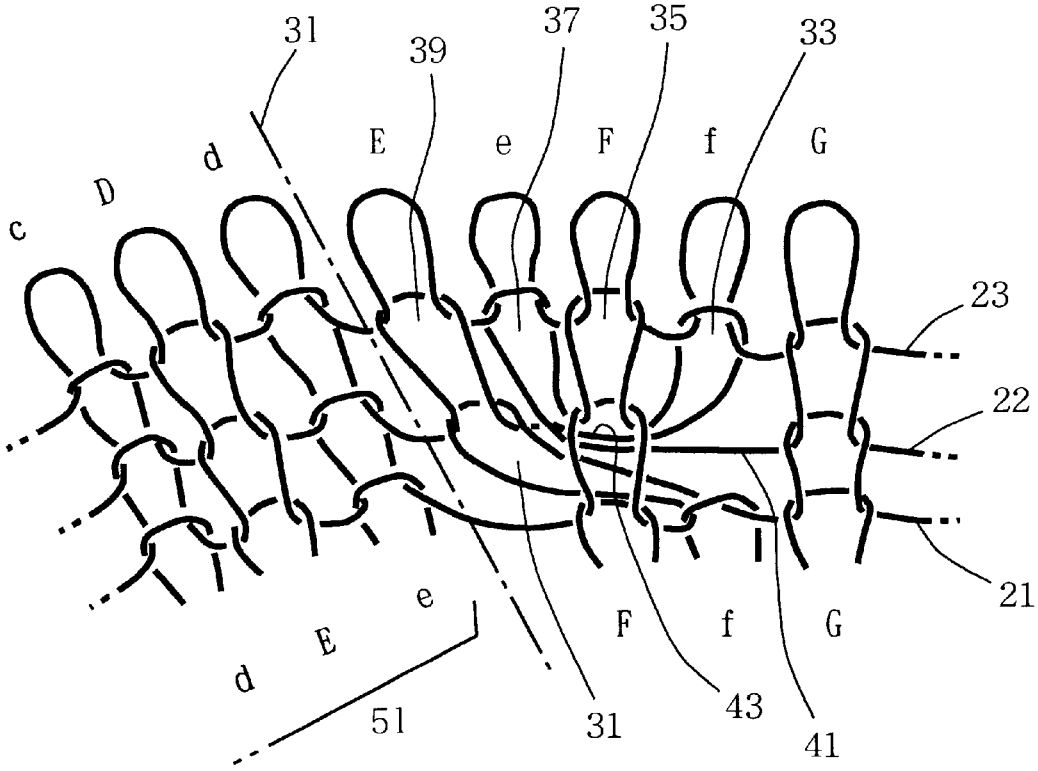
Figures 1, 2, 3, 4, 5, 6, 7, 8, 9, 10:
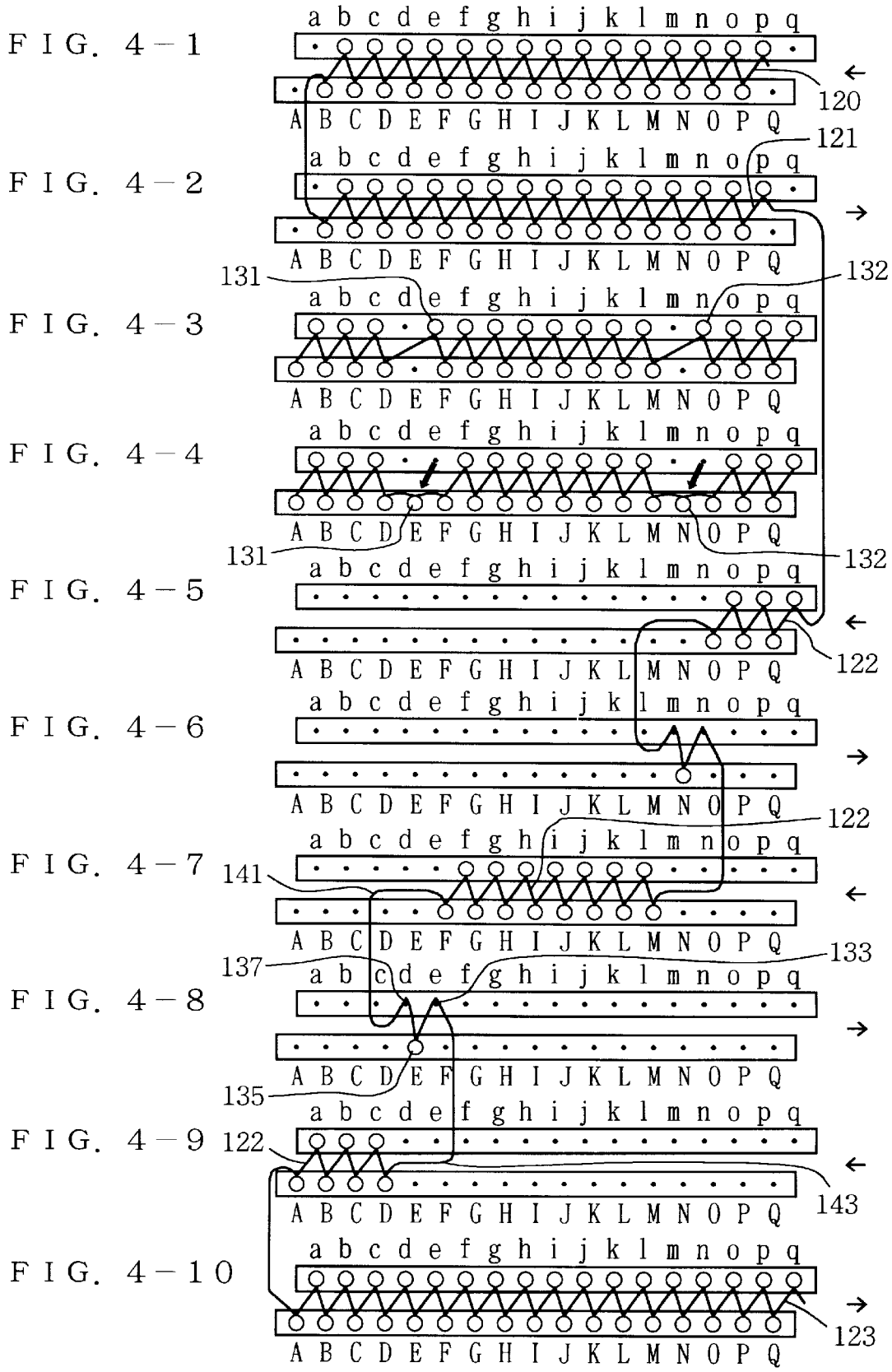
Figure 5:
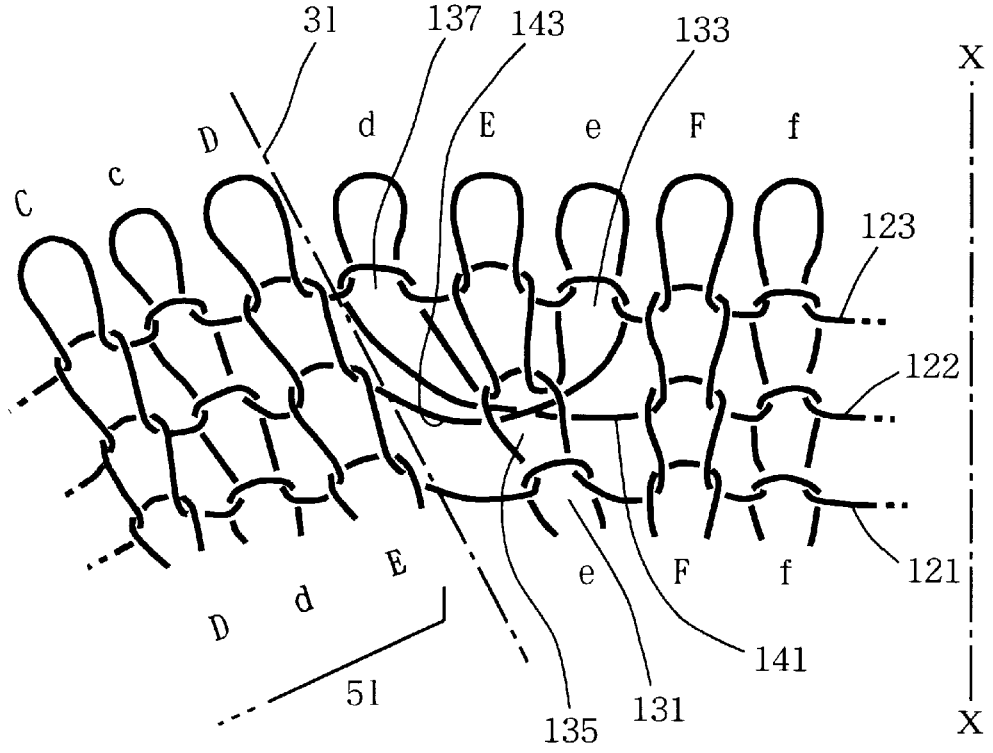
Figure 6:
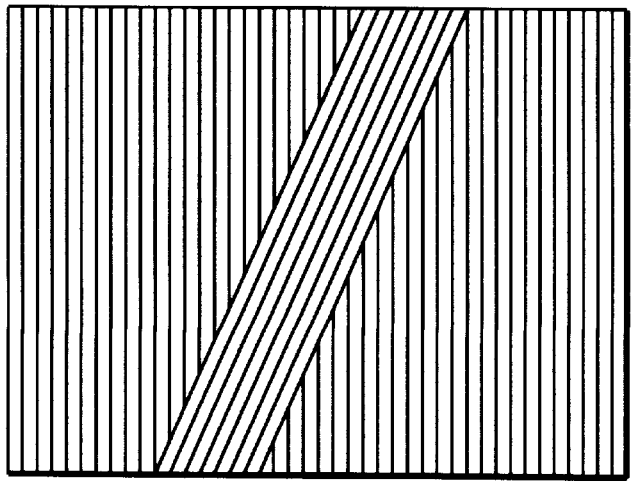
Figures 6, 7:
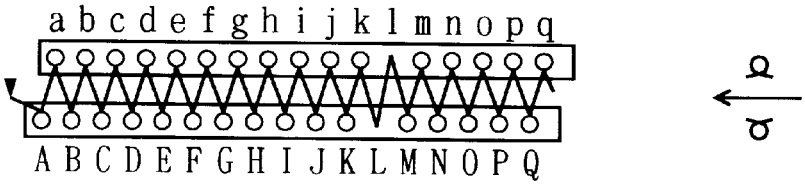
Figures 5, 7:
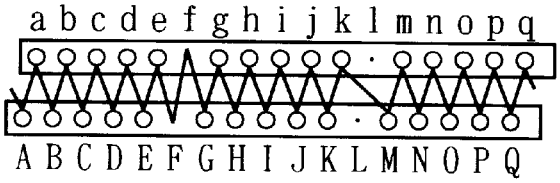
Figures 4, 7:
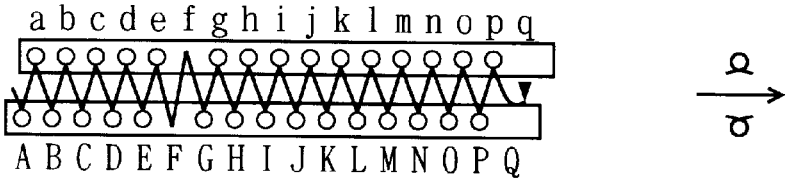
Figures 3, 7:
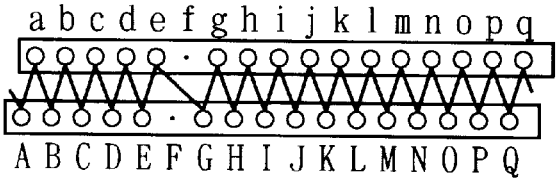
Figures 2, 7:
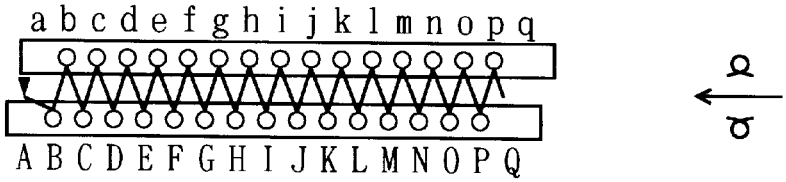
Figures 1, 7:
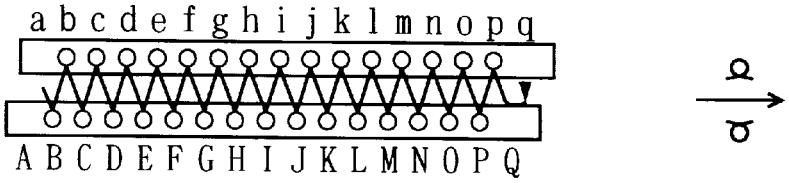

FIG. 2 shows knitting steps of rib courses, including the internally widened portion S, of the knitted fabric 1 shown in FIG. 1. Capital letters of alphabet in the diagram indicate needles of the front needle bed, and small letters of alphabet indicate needles of the back needle bed. For convenience of description, the number of needles illustrated is smaller than the actual number of needles used for knitting. FIG. 3 shows enlargedly the loop structure of the widened area P shown in FIG. 1.

First, in steps 1, 2, the yarn feeder (not illustrated) is reciprocated once over the entire knitting range to feed the yarn zigzag to the needles B~P of the front needle bed and the needles b~p of the back needle bed to form rib courses 20, 21. Next, a group of stitches of the left side part 51 of the rib knitted fabric 1, being held on the needles B~E of the front needle bed, and a group of stitches of the same part 5*l*, being held on the needles b~e of the back needle bed are shifted leftward by one needle to place them on the needles A~D of the front needle bed and on the needles a~d of the back needle bed, respectively. In a similar way, a group of stitches of the right side part 5*r* of the rib knitted fabric 1, being held on the needles M~P of the front needle bed, and a group of stitches of the same part 5*r*, being held on the needles m~p of the back needle bed are shifted rightward by one needle to place them on the needles N~Q of the front needle bed and on the needles n~q of the back needle bed, respectively. This shift is made by transfer and racking. For example, in the case of a two-bed flat knitting machine having a pair of a front needle bed and a back needle bed, stitches are shifted one by one, starting from the most outward stitch of the knitting range. In the case of a flat knitting machine having transfer jack beds, etc. in addition to the pair of front and back needle beds, stitches can be shifted efficiently since a group of stitches can be kept on transfer jacks.

By these shifts of stitches, a pair of needles E, e of the front and back needle beds and a pair of needles M, m of the front and back needle beds are made empty (step 3).

Next, in this embodiment, to form new stitches in an widened area of which needles have been made empty, as shown in step 4, stitches 31, 32 being held on needles f, l adjacent to the empty needles e, m of the back needle bed are moved onto the empty needles E, M of the front needle bed, respectively. In step 4, back stitches bs are moved onto the needles E, M of the front needle bed for forming wales of face stitches fs on the face side 10*f* of the knitted fabric to supplement these empty needles for forming face stitch wales with stitches.

To knit a next rib course 22, in next step 5, the yarn feeder is moved leftward from the right side of the knitting range and beyond the needle l of the back needle bed to feed the yarn to the needles Q~N of the front needle bed and the needles q~n of the back needle bed to knit the side part 5*r* on the right of the widening line 3*r*. In next step 6, the travelling direction of the yarn feeder is reversed to feed the yarn to the needles l, m of the back needle bed and the needle M of the front needle bed being located between these needles l, m to hook the yarn on the empty needles l, m and form, on the needle M, a face stitch in succession to the back stitch 32 formed on the needle l in step 2. In step 7, the yarn feeder is reversed again to feed the yarn to the needles L~G of the front needle bed and the needles k~g of the back needle bed to rib-knit the central part 7. In step 8, the yarn feeder is reversed and moved rightward to feed the yarn to the needles e, f of the back needle bed and the needle F of the front needle bed to hook the yarn on the empty needles e, f and form a stitch 35 on the needle F. 41 denotes a yarn portion crossing over from the needle G of the front needle bed to the needle e of the back needle bed. In step 9, the yarn feeder is reversed again and moved to feed the yarn to the needles E~A of the front needle bed and the needles d~a of the back needle bed to rib-knit the side part 5*l* on the left of the widening line 3*l*. 43 denotes a yarn portion crossing over from the needle f of the back needle bed to the needle E of the front needle bed. By these steps 5~9, a single rib course 22 is formed over the entire knitting range of the knitted fabric 1.

As a result of the above-mentioned steps, four wales are added to the rib knitted fabric, and the knitting range is expanded from the initial needles B~p of the front and back needle beds to the needles A~q of the front and back needle bed. In step 10, the yarn is fed to the needles A~Q of the front needle bed and the needles a~q of the back needle bed to form a stitch course 23 over the entire knitting range of the rib knitted fabric 1.

When the knitting described in steps 1~10 is repeated, the knitted fabric 1 shown in FIG.1 is formed. In knitting, as can be seen in FIG. 1, the knitting range of the central part 7 is increased stepwise, and with this expansion of the range, the needles made empty in step 3 change from E·e and M·m to D·d and N·n, C·c and O·o, . . . When steps 1~10 are used as a basic cycle for widening, widening is effected in every four courses. When the frequency of widening is raised relative to the number of courses, for example, when steps 2~9 are used as a basic cycle, widening is effected for every two courses.

In step 4 mentioned above, in the widening line 3*l*, the stitch held on the needle f adjacent to the empty needle e of the back needle bed is moved onto the need E of the front needle bed. In place of this stitch, a stitch held on the needle d may be moved. Similarly, in the widening line 3*r*, a stitch held on the needle n may be moved onto the needle M.

Version

Next, a version of the present invention will be described. FIG. 4 shows knitting steps corresponding to those of the embodiment shown in FIG. 2. FIG. 5 corresponds to FIG. 3 and shows enlargedly the loop structure of the widened area P in FIG. 1.

This version differs from the above-mentioned embodiment in that, while in the embodiment needles made empty in step 3 are needles E·e and M·m, in the present version needles d·E and m·N are made empty, and also in that in this version stitches held on needles e, n adjacent to empty needles d, m of the back needle bed are moved onto empty needles E, N of the front needle bed, respectively. In other aspects, the version and the embodiment are basically the same with each other.

In steps 1, 2, the yarn is alternately fed to the needles B~P of the front needle bed and the needles b~p of the back needle bed in a zigzag manner to form rib courses 120, 121. Next, groups of stitches of the left side part 5*l* of the rib knitted fabric 1 held on the needles B~E of the front needle bed and the needles b~d of the back needle bed are shifted leftward by one needle and placed on the needles A~D of the front needle bed and the needles a~c of the back needle bed. Similarly, groups of stitches of the right side part 5*r* of the rib knitted fabric 1 being held on the needles N~P of the front needle bed and the needles m~p of the back needle bed are shifted rightward by one needle and placed on the needles O~Q of the front needle bed and the needles n~q of the back needle bed. With the above-mentioned shifts, the needles d, E of the front and back needle beds and the needles m, M of the front and back needle beds are made empty (step 3).

Next, as shown in step 4, stitches 131, 132 held on needles e, n adjacent to empty needles d, m of the back needle bed are transferred onto the empty needles E, N of the front needle bed. By this, back stitches bs are moved onto the needles of the front needle bed for forming wales of face stitches fs on the face side 10*f* of the knitted fabric to supplement these empty needles for forming face stitch wales with stitches. In the case of the present version, racking of the needle bed for transferring the stitch from the needle e to the needle E and transferring the stitch from the needle n to the needle N is common and can be done with a small racking (leftward, one half needle pitch). Hence the loads to the stitches can be reduced and the knitting efficiency is raised.

Next, in step 5, to knit the next rib course 122, the yarn feeder being not illustrated is moved from the right side of the knitted fabric to and beyond the needle m of the back needle bed to feed the yarn to the needles Q~O of the front needle bed and the needles q~o of the back needle bed to knit the side part 5*r* on the right of the widening line 3*r*.

In next step 6, the travelling direction of the yarn feeder is reversed to feed the yarn to the needles m, n of the back needle bed and the needle N of the front needle bed to hook the yarn on the empty needles m, n and form, on the needle N, a face stitch in succession to the back stitch 132 that was formed on the needle n in step 2. In step 7, the yarn feeder is reversed again to feed the yarn to the needles M~F of the front needle bed and the needles l~f of the back needle bed to rib-knit the central part 7. In step 8, the yarn feeder is reversed and moved rightward to feed the yarn to the empty needles d, e of the back needle bed and the needle E of the front needle bed to hook the yarn on the empty needles d, e and form a stitch 135 on the needle E in succession to the back stitch 131 that was formed on the needle e in step 2. 141 denotes a yarn portion crossing over from the needle F of the front needle bed to the needle d of the back needle bed. In step 9, the yarn feeder is reversed again and moved to feed the yarn to the needles D~A of the front needle bed and the needles c~a of the back needle bed to rib-knit the side part 5*l* on the left of the widening line 3*l*. 143 denotes a yarn portion crossing over from the needle e of the back needle bed to the needle D of the front needle bed. By these steps 5~9, a single rib course 122 is formed over the entire knitting range of the knitted fabric 1.

As a result of the above-mentioned knitting steps, four wales are added to the knitted fabric 1, and the knitting range is expanded from the initial needles B~p of the front and back needle beds to the needles A~q of the front and back needle bed. In step 10, the yarn is fed to the needles A~Q of the front needle bed and the needles a~q of the back needle bed to form a stitch course 123 over the entire knitting range of the rib knitted fabric 1. In the case of the present version, widened areas of the same loop structure are formed along the widening lines 3*l*, 3*r*.

The loop structure of the widened area formed along the widening line 3*r* in the above-mentioned embodiment is equivalent to the loop structure of the widened area formed along the widening line 3*r* in this present version. The former is identical to a loop structure generated by symmetrically moving the loop structure of FIG. 5 with respect to the line X—X.

Supplementary Explanation

In the embodiment and the version mentioned above, widening is made at the same ratio in both the right and left sides of the rib knitted fabric. The invention is not limited to this; widening may be done just in one side of the knitting range or widening may be done at different widening ratios with respect to the number of courses in the right and the left to knit a rib knitted fabric of any desired form. Moreover, internal widening does not necessarily mean increasing the knitting range of a knitted fabric. A group of stitches of wales to be moved for forming an empty needle in a widened area does not need to be located in a side part of a knitted fabric. For example, a knitted fabric shown in FIG. 6 is knitted from the bottom to the top of the diagram, and the group of stitches of the central part of the diagram is shifted rightward sequentially to overlap it with the group of stitches on the right side and form a bias pattern. If widening according to the present invention is applied to the boundary between the group of stitches of the central part and the left side part when the central part is moved, generation of holes in the widening line can be prevented. The present invention is applicable to knitting of such knitted fabrics.

What is claimed is:

1. A widening method for a rib knitted fabric using a flat knitting machine having at least a pair of a front needle bed and a back needle bed being relatively movable leftward and rightward, said method characterized by the following steps after making empty a pair of needles comprising a needle of the front needle bed and a needle of the back needle bed:

a. a step for making empty adjacent two needles on one needle bed by transferring a stitch held on a needle adjacent to one of said pair of empty needles to the other needle of said pair of empty needles;

b. a step for rib knitting by, while a yarn feeder is made to travel beyond said adjacent two empty needles, feeding yarn in the travelling direction of the yarn feeder to needles of both the front and back needle beds, up to the needle just short of said adjacent two empty needles;

c. a step for, while said yarn feeder is reversed and moved, hooking yarn on one of said adjacent two empty needles, forming a stitch on a needle of the other needle bed located between said two adjacent empty needles, and hooking yarn on the other needle of said two adjacent empty needles; and d. a step for feeding yarn to needles of both the front and back needle beds to rib-knit, said needles being in succession to said two adjacent needles, while said yarn feeder is reversed again and moved.

2. A widening method for a rib knitted fabric of claim 1 characterized in that said needle of the other needle bed located between said two adjacent empty needles is the original empty needle to which a stitch is transferred in said step a.

3. A widening method for a rib knitted fabric of claim 1 characterized in that at least on one of left and right side parts of the rib knitted fabric, the steps a~d are repeated to expand the knitting range of the rib knitted fabric.

4. A widened rib knitted fabric having a large number of stitches, rows of said stitches along the knitting direction forming courses and columns of said stitches perpendicular to the courses forming wales, wherein a pair of widening wales are provided on both sides of a central wale, at a first course of said pair of widening wales, a stitch of a wale adjacent to three wales comprising said central wale and said pair of widening wales and outside one side of the group of said three wales, and a first stitch of one of the widening wales are connected by cross-over yarn crossing said three wales and striding over the central wale, a stitch of the central wale in said first course is connected to said first stitch of one of the widening wales, and a first stitch of the other widening wale in said first course is connected to said stitch of the central wale, and a stitch of a wale in said first course adjacent to said three wales and outside the other side of the group of said three wales is connected to the first stitch of the other widening wale.

5. A widened rib knitted fabric of claim 4 having a course immediately preceding said first course of said pair of widening wales and characterized in that said stitch of the wale adjacent to three wales and outside one side is connected to a stitch of the same wale in said immediately preceding course, and that said stitch of the wale adjacent to said three wales and outside the other side is connected to a stitch of the same wale in said immediately preceding course.

* * * * *